US006161805A

United States Patent [19]

Wells

[11] Patent Number: 6,161,805

[45] Date of Patent: Dec. 19, 2000

[54] ERGONOMIC HAND REST FOR GAMING MACHINE

[76] Inventor: John C. Wells, 213 Yellow Sky St., Las Vegas, Nev. 89128

[21] Appl. No.: 09/301,818

[22] Filed: Apr. 29, 1999

[51] Int. Cl.[7] ..... B68G 5/00

[52] U.S. Cl. ..... 248/118; 248/118.1; 248/918; 273/142 R; 273/143 R

[58] Field of Search ..... 248/118, 118.1, 248/118.3, 118.5, 281.11, 214, 227.4, 918, 422; 463/13, 16, 34–36, 47; D21/327, 370, 385; 273/143 R, 138 A, 138 R, 142 R

[56] References Cited

U.S. PATENT DOCUMENTS

| | | | |
|---|---|---|---|
| D. 344,296 | 2/1994 | McKat et al. | D21/37 |
| D. 406,612 | 3/1999 | Johnson | D21/327 |
| D. 406,865 | 3/1999 | Heidel | D21/385 |
| 4,351,563 | 9/1982 | Hattori | 248/118 X |
| 5,465,931 | 11/1995 | MacDonald | 248/118.3 |
| 5,709,489 | 1/1998 | Ambrose | 248/118.1 X |
| 5,807,177 | 9/1998 | Takemoto et al. | 463/47 |
| 5,902,184 | 5/1999 | Bennett | 463/13 |
| 6,012,982 | 1/2000 | Piechowiak et al. | 463/16 |

*Primary Examiner*—Anita M. King
*Assistant Examiner*—Tan Le
*Attorney, Agent, or Firm*—Jeffrey Weiss; Jeffrey D. Moy; Weiss & Moy

[57] ABSTRACT

An ergonomic hand rest assembly for attachment to a gaming machine that includes a housing having a pair of upright, oppositely facing panels. A pair of support arms are mounted to the panels, and support bar is arranged to extend between the support arms spaced apart from the housing. A frame is mounted to the support bar, and a pad is mounted on the frame.

14 Claims, 2 Drawing Sheets

ERGONOMIC HAND REST FOR GAMING MACHINE

BACKGROUND OF THE INVENTION

This invention relates to an ergonomic hand rest for a gaming machine such as a slot machine or a video poker machine and method therefor.

Existing video gaming machines typically have a video display and a keyboard. No provision is made for an ergonomic hand rest for users of such machines.

SUMMARY OF THE INVENTION

The present invention provides an ergonomic hand rest that may be either mounted on existing gaming machines or included as a standard feature in new machines and a method therefor.

An ergonomic hand rest assembly according to the present invention is for attachment to a gaming machine that includes a housing having a pair of upright, oppositely facing panels. The ergonomic hand rest assembly according to the present invention comprises a pair of support arms mounted to the panels. A support bar is arranged to extend between the support arms and is spaced apart from the housing. A frame is mounted to the support bar, and a pad is mounted on the frame.

The support arms preferably are rotatably mounted to the panels. The ergonomic hand rest assembly preferably further includes a pair of stops arranged to limit the range of rotational motion of the support arms.

A bracket may be arranged to mount the frame to the support bar.

An appreciation of the objectives of the present invention and a more complete understanding of its structure and method of operation may be had by studying the following description of the preferred embodiment and by referring to the accompanying drawings.

DETAILED DESCRIPTION OF THE INVENTION

Figure 1:
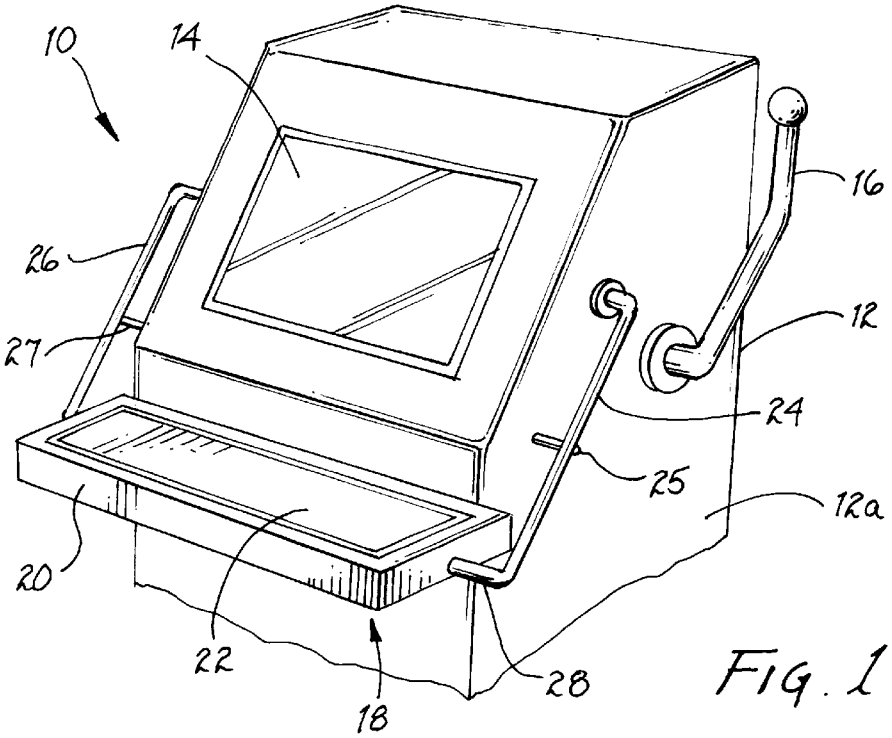
FIG. 1 is a perspective view of an ergonomic hand rest according to the present invention mounted to a gaming machine.
Figure 4:
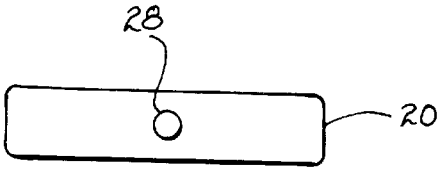
FIG. 4 is a side elevational view of the frame and support bar that may be included in the ergonomic hand rest according to the present invention.

As shown in FIGS. 1, a gaming machine 10, such as a slot machine, includes a housing 12 that includes vertical spaced apart panels 12*a* and 12*b*. A display 14 mounted in the housing 12. The gaming machine 10 includes an operating arm 16 extending from the housing 12 in the well-known manner.

An ergonomic hand rest assembly 18 is mounted to the housing 12 to provide a comfortable, convenient place for resting the hands of a person using the gaming machine 10. The hand rest assembly includes a frame 20 arranged to hold a soft rubber pad 22.

The frame 20 is mounted to the housing 12 by a pair of support arms 24 and 26. A support bar 28 extends between the support arms 24 and 26. Ordinarily the support arms 24 and 26 and the support bar will be formed integrally as one piece of metal or plastic tubing. The frame 2C0 is mounted to the support bar 26 so that the frame 20 and pad 22 are arranged to provide a comfortable, convenient hand rest.

Figure 2:
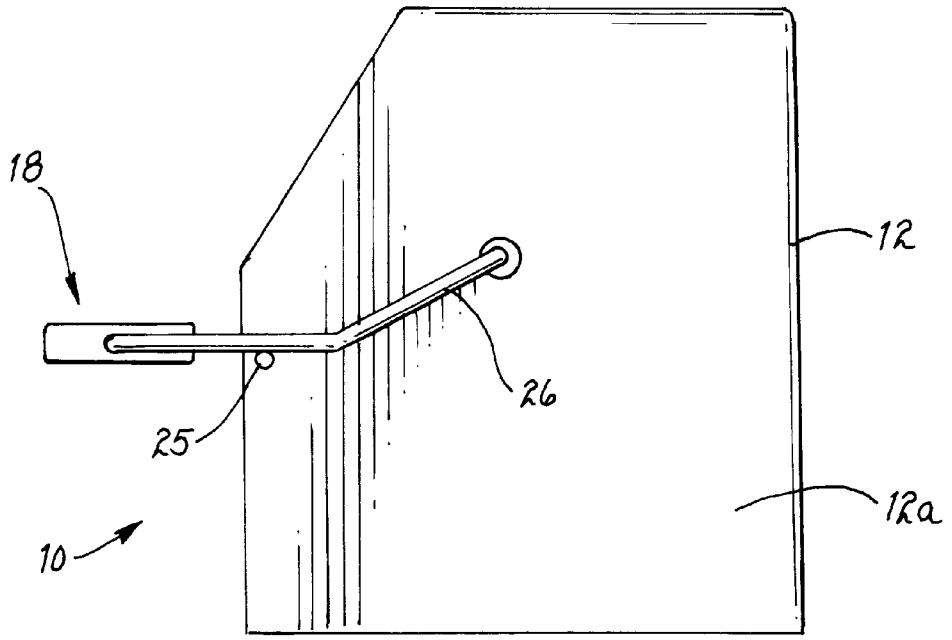
FIG. 2 is a side view of the apparatus of FIG. 1.
Figure 3:
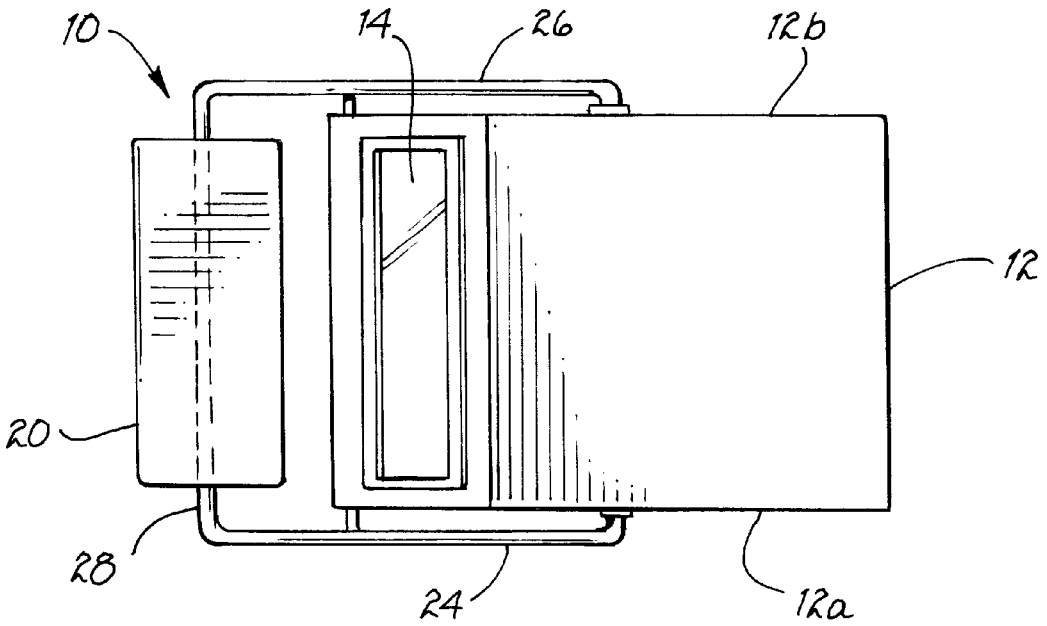
FIG. 3 is a plan view of the apparatus of FIG. 1.

The support arms 24 and 26 preferably are rotatably mounted to the housing 12. A pair of stops 25 and 27 extend from the housing to engage the support arms 24 and 26 and limit the range of angular motion of the support arms 24 and 26. The support arms may be either straight as shown in FIG. 1 or angled as shown in FIG. 2. The support arms preferably are arranged so that the frame 20 can be rotated upward when the person using the gaming machine 10 does not want to use the hand rest assembly 18.

The support bar may pass through the frame 20 as shown in FIGS. 1–4. The frame 20 includes a passage for the support bar 28. A close fitting relationship between the support bar 28 and the passage 30 allows adjustment of the angular position of the frame, while still retaining a pre-set position in normal usage.

Figure 5:
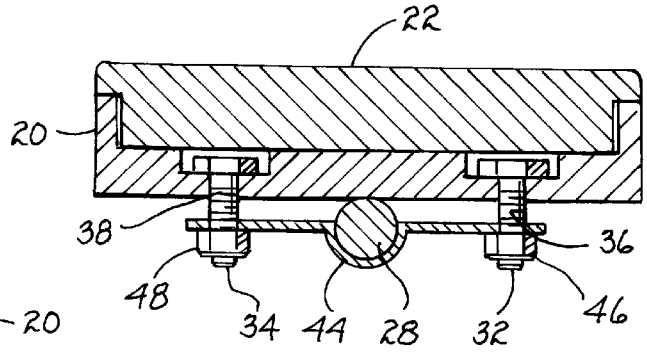
FIG. 5 is a cross sectional view showing a hand rest pad and apparatus for mounting the hand rest pad to a support bar.

FIG. 5 illustrates another apparatus for mounting the frame 20 on the support bar 28. A pair of bolts 32 and 34 extend through corresponding holes 36 and 38 in the frame and through holes 40 and 42 in a mounting bracket 44. Nuts 46 and 48 are threaded onto the bolts 32 and 34, respectively to retain the support bar 28 between the mounting bracket 44 and the frame 20. In most applications it is expected that two or more mounting brackets will be used to hold the frame securely to the support bar 28.

The hand rest assembly 18 according to the present invention is designed to be suitable for retrofitting existing gaming machines. The hand rest assembly 18 may also be included in the construction of a new gaming machine or similar apparatus (not shown).

The structures and methods disclosed herein illustrate tile principles of the present invention. The invention may be embodied in other specific forms without departing from its spirit or essential characteristics. The described embodiments are to be considered in all respects as exemplary and illustrative rather than restrictive. Therefore, the appended claims rather than the foregoing description define the scope of the invention. All modifications to the embodiments described herein that come within the meaning and range of equivalence of the claims are embraced within the scope of the invention.

What is claimed is:

1. An ergonomic hand rest assembly for attachment to a gaming machine (10) comprising, in combination:

a hand rest assembly; a gaming machine coupled to the hand rest assembly and comprising a housing (12) having a pair of upright oppositely facing panels (12*a*, 12*b*);

the hand rest assembly comprising:

a pair of support arms (24, 26) mounted to the panels of the housing (12*a*, 12*b*), respectively;

a support bar (28) arranged to extend between the support arms (24, 26) and spaced apart from the housing (12);

a frame (20) mounted to the support bar (28); and a pad (22) mounted on the frame (20).

2. The ergonomic hand rest assembly of claim 1 wherein the support arms (24, 26) are rotatably mounted to the panels (12*a*, 12*b*).

3. The ergonomic hand rest assembly of claim 2, further including a pair of stops (25, 27) arranged to limit the range of rotational motion of the support arms (24, 26).

4. The ergonomic hand rest assembly of claim 1, further including a bracket (44) arranged to mount the frame (20) to the support bar (28).

5. The ergonomic hand rest assembly of claim 1 wherein said gaming machine is a slot machine.

6. The ergonomic hand rest assembly of claim 1 wherein said gaming machine is a video gaming machine.

7. The ergonomic hand rest assembly of claim 6 wherein said video gaming machine is a video poker machine.

8. A method of providing an ergonomic hand resist assembly for attachment to a gaming machine for use by a person playing the gaming machine comprising the steps of:

providing a gaming machine comprising a housing having a pair of upright, oppositely facing panels;

connecting a pair of support arms mounted to the panels, respectively;

providing a support bar arranged to extend between the support arms and spaced apart from the housing;

providing a frame mounted to the support bar; and providing a pad mounted on the frame.

9. The method of claim 8 wherein the support arms are rotatably mounted to the panels.

10. The method of claim 8 further including a pair of stops arranged to limit the range of rotational motion of the support arms.

11. The method of claim 8 further including a bracket arranged to mount the frame to the support bar.

12. The method of claim 8 wherein said gaming machine is a slot machine.

13. The method of claim 8 wherein said gaming machine is a video gaming machine.

14. The method of claim 13 wherein said video gaming machine is a video poker machine.

* * * * *